US006892742B2

(12) United States Patent
Wang

(10) Patent No.: US 6,892,742 B2
(45) Date of Patent: May 17, 2005

(54) TENT

(76) Inventor: Ching-Hsuan Wang, No. 3, Chenchung Rd., Erhchen Village, Kuantien Hsiang, Tainan Hsien (TW)

( * ) Notice: Subject to any disclaimer, the term of this patent is extended or adjusted under 35 U.S.C. 154(b) by 104 days.

(21) Appl. No.: 10/428,814

(22) Filed: Mar. 2, 2003

(65) Prior Publication Data

US 2004/0168715 A1 Sep. 2, 2004

(51) Int. Cl.[7] ..... E04H 15/40; E04H 15/42
(52) U.S. Cl. ..... 135/125; 135/115; 135/136
(58) Field of Search ..... 135/124, 125, 135/128, 136–138

(56) References Cited

U.S. PATENT DOCUMENTS 1,247,196 A * 11/1917 Willett ..... 135/90
2,181,016 A * 11/1939 Gross ..... 47/29.1
3,039,478 A * 6/1962 Timmons ..... 135/137
3,130,739 A * 4/1964 Von Kohorn ..... 52/2.17
3,625,235 A * 12/1971 Gorgichuk ..... 135/87
4,352,362 A * 10/1982 Nichols ..... 135/98
4,665,935 A * 5/1987 Nichols ..... 135/125
5,273,142 A * 12/1993 Weber ..... 190/107
5,301,706 A * 4/1994 Jones ..... 135/125
5,421,355 A * 6/1995 Cantwell ..... 135/120.3
5,642,750 A * 7/1997 Brown et al. ..... 135/137
6,371,143 B1 * 4/2002 Swetish ..... 135/125
2002/0179133 A1 * 12/2002 Abbinante ..... 135/124

* cited by examiner

*Primary Examiner*—Robert Canfield
(74) *Attorney, Agent, or Firm*—Dellett & Walters

(57) ABSTRACT

A tent has a framework having at least two flexible strips bent with an intersection at central points of the strips as a top of the tent. A flexible ring is provided outside the flexible strips and adjacent to the top of the tent. A cloth is sheathed on the framework. The tent has a broad top space without a central pole, which is convenient to use in hunting or as a business site.

14 Claims, 6 Drawing Sheets

TENT

BACKGROUND OF THE INVENTION

1. Field of the Invention

The present invention is related to a simple tent, and more particularly to a simple tent which is easy to be unfolded or folded, and has a broad top space.

2. Description of Related Art

Referring to FIG. 5, a conventional closed tent is composed of a cloth enclosure (40) sheathed on a framework (41). The tent is generally used in outdoor sports, such as camping, or hunting. However, the conventional tent has such a narrow top space that it is inconvenient for a user to take actions, such as shooting during hunting.

Referring to FIG. 6, a conventional open tent is composed of an open cloth (50) sheathed on a framework (52) with a central pole (51). The open tent is often used as a business site in fairs or markets. However, a space available in the tent is limited by the central pole (51), which is inconvenient for merchants and their clients.

Therefore, the invention provides a simple tent to mitigate and/or obviate the aforementioned problems.

SUMMARY OF THE INVENTION

The main objective of the invention is to provide a simple tent which has a broad top space.

Other objectives, advantages and novel features of the invention will become more apparent from the following detailed description when taken in conjunction with the accompanying drawings.

DETAILED DESCRIPTION OF THE PREFERRED EMBODIMENT

Figure 3:
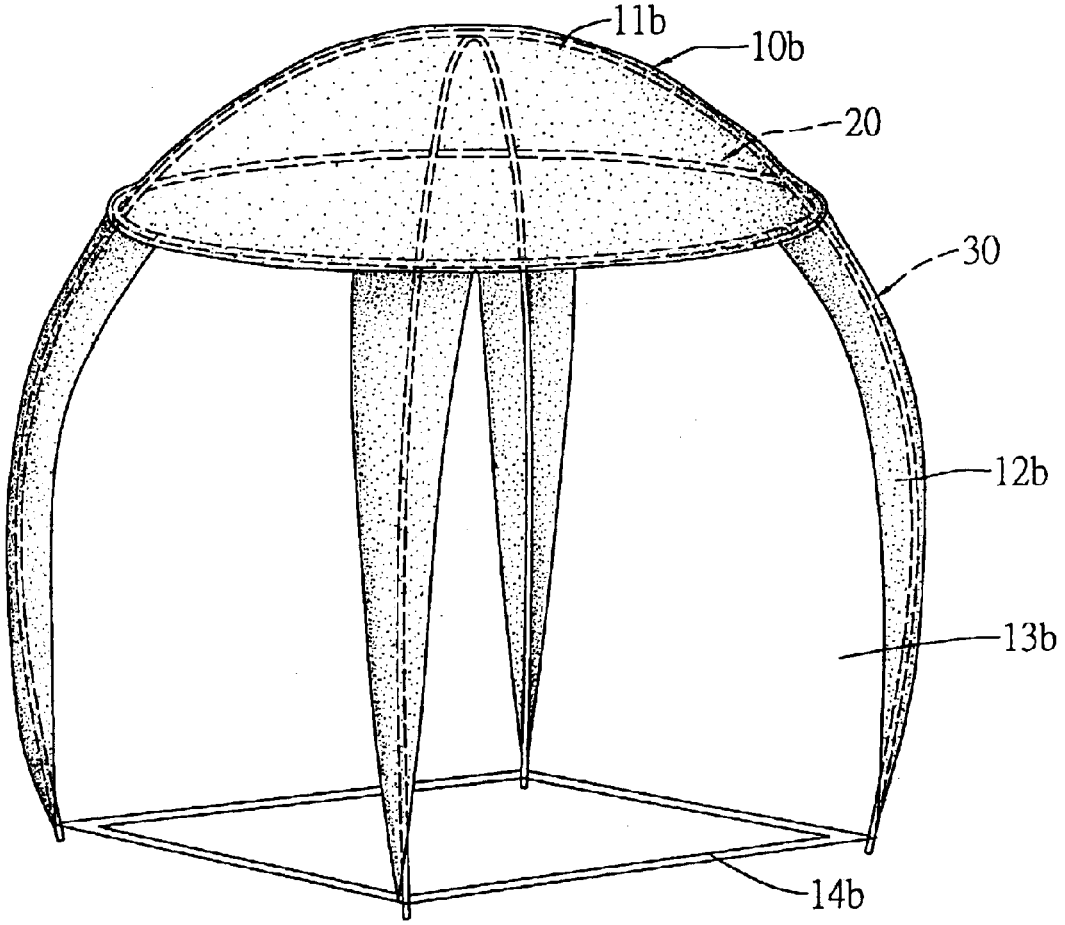
FIG. 3 is a perspective view of an open tent in accordance with the invention.
Figure 4:
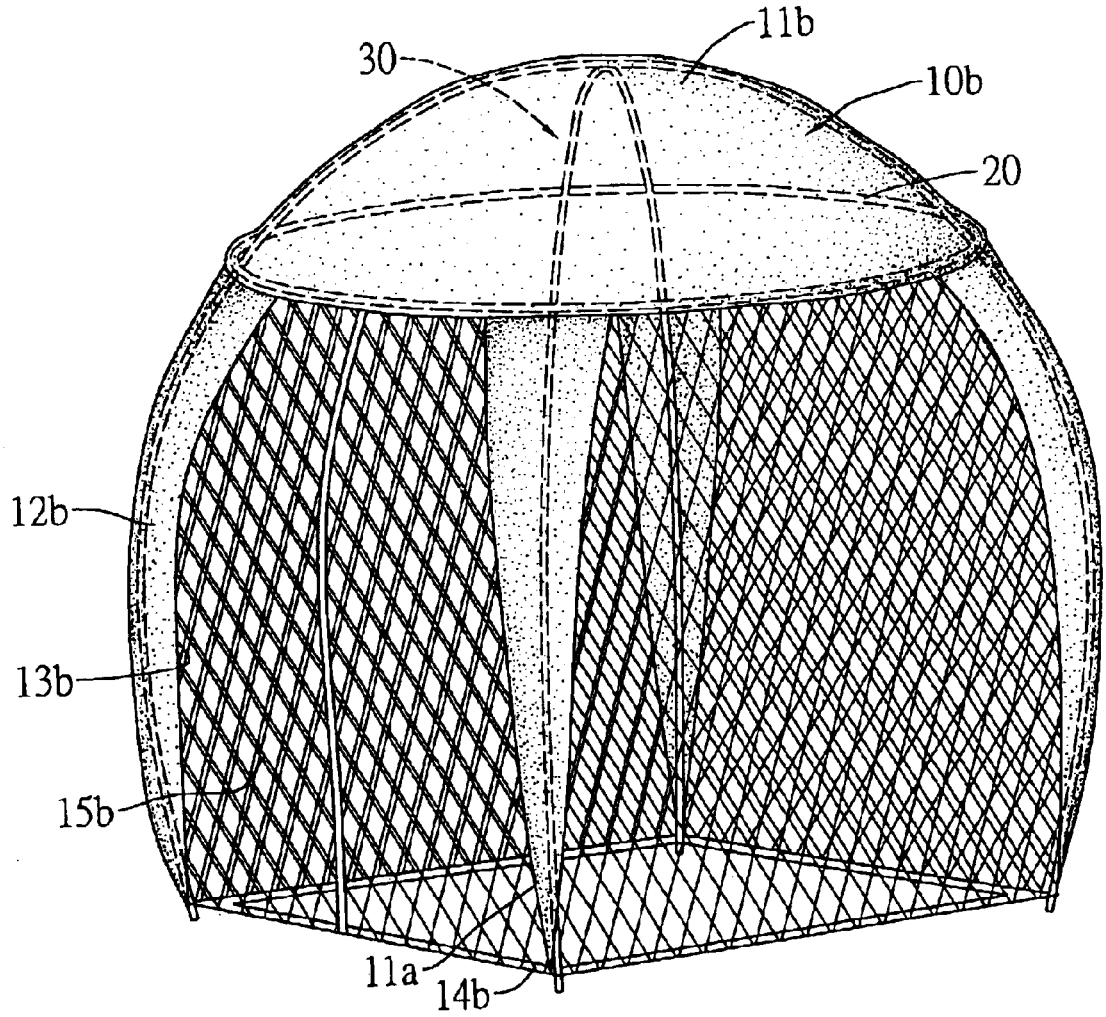
FIG. 4 is a perspective view of the open tent in FIG. 3 provided with nets.
Figure 5:
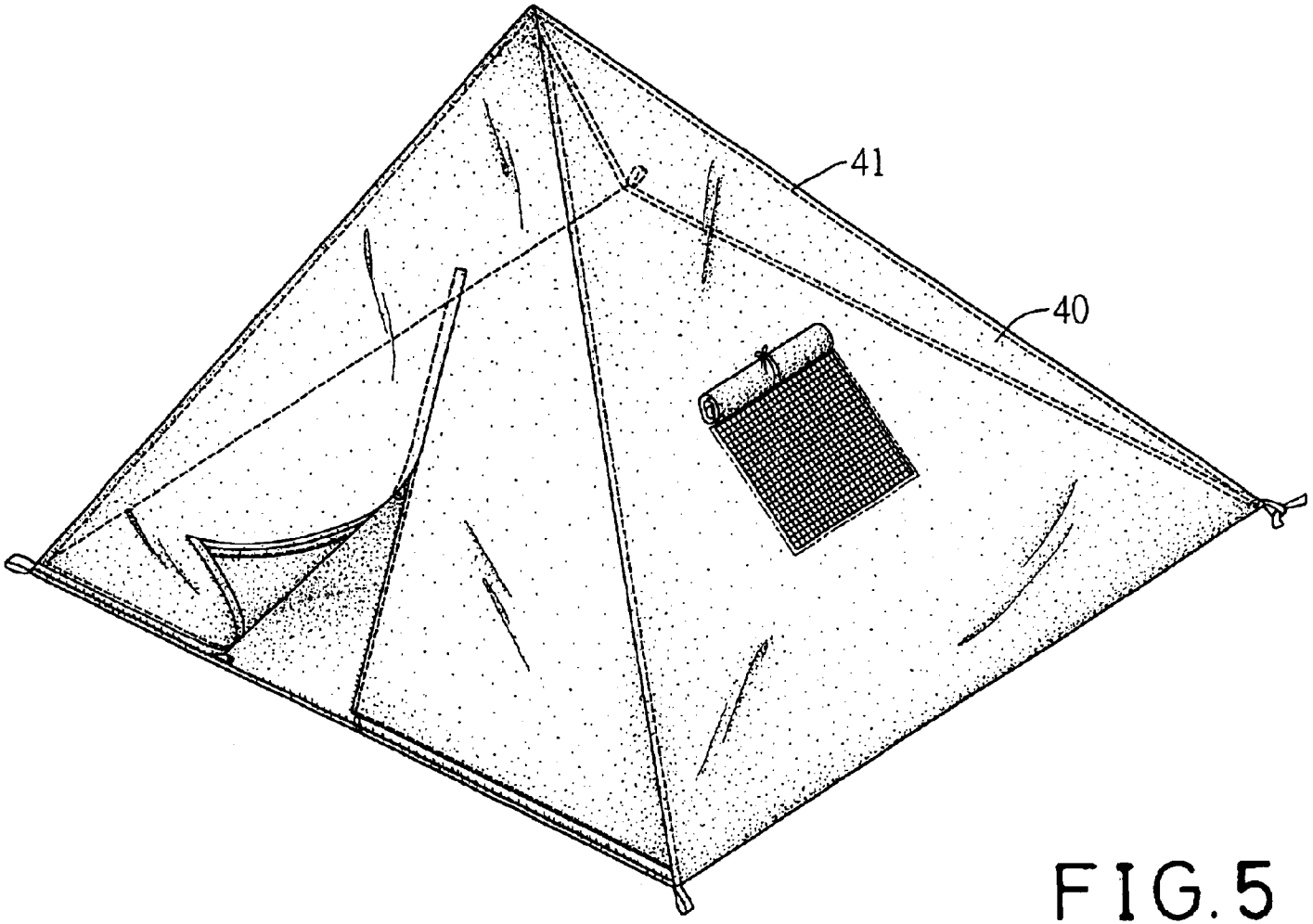
FIG. 5 PRIOR ART
FIG. 5 is a perspective of a conventional closed tent.
Figure 6:
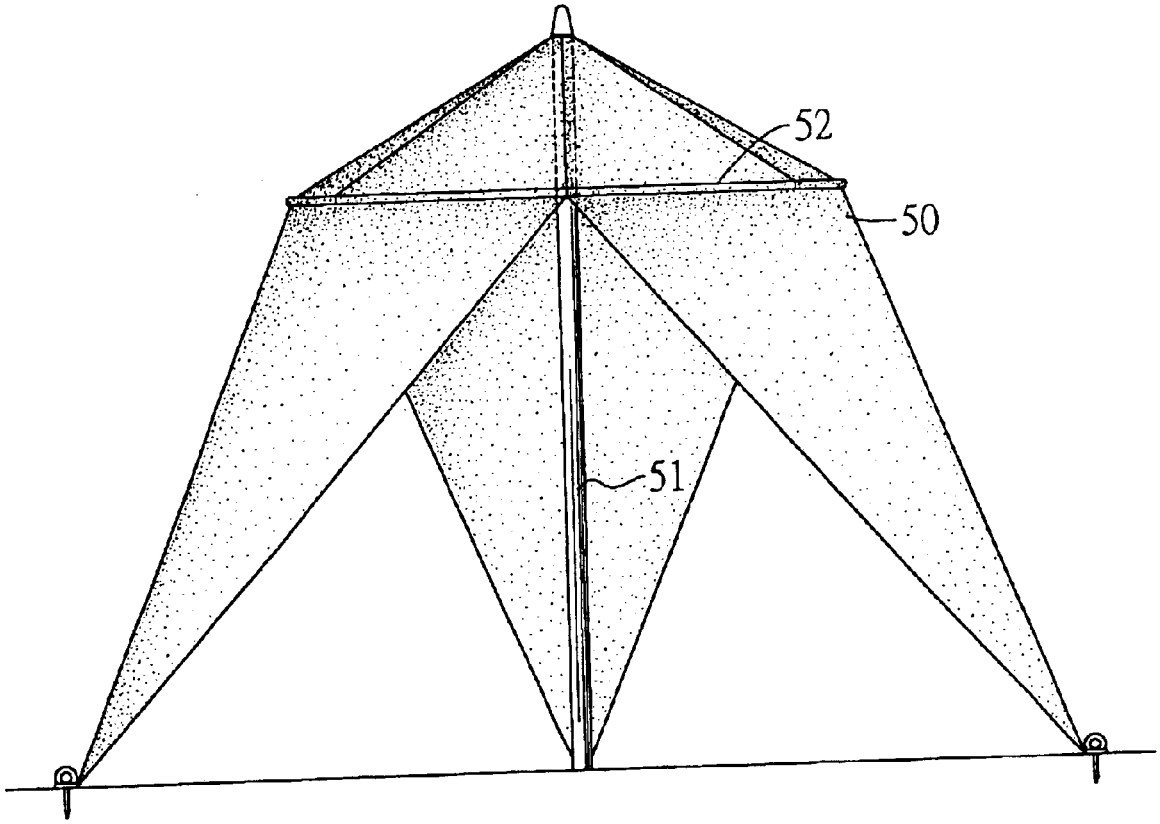
FIG.6 PRIOR ART
FIG. 6 is a perspective of a conventional open tent.

In accordance with the present invention, a simple tent can be made as a closed configuration and an open configuration. Embodiments of the closed configuration are illustrated in FIGS. 1 and 2, and embodiments of the open configuration are illustrated in FIGS. 3 and 4.

Figure 1:
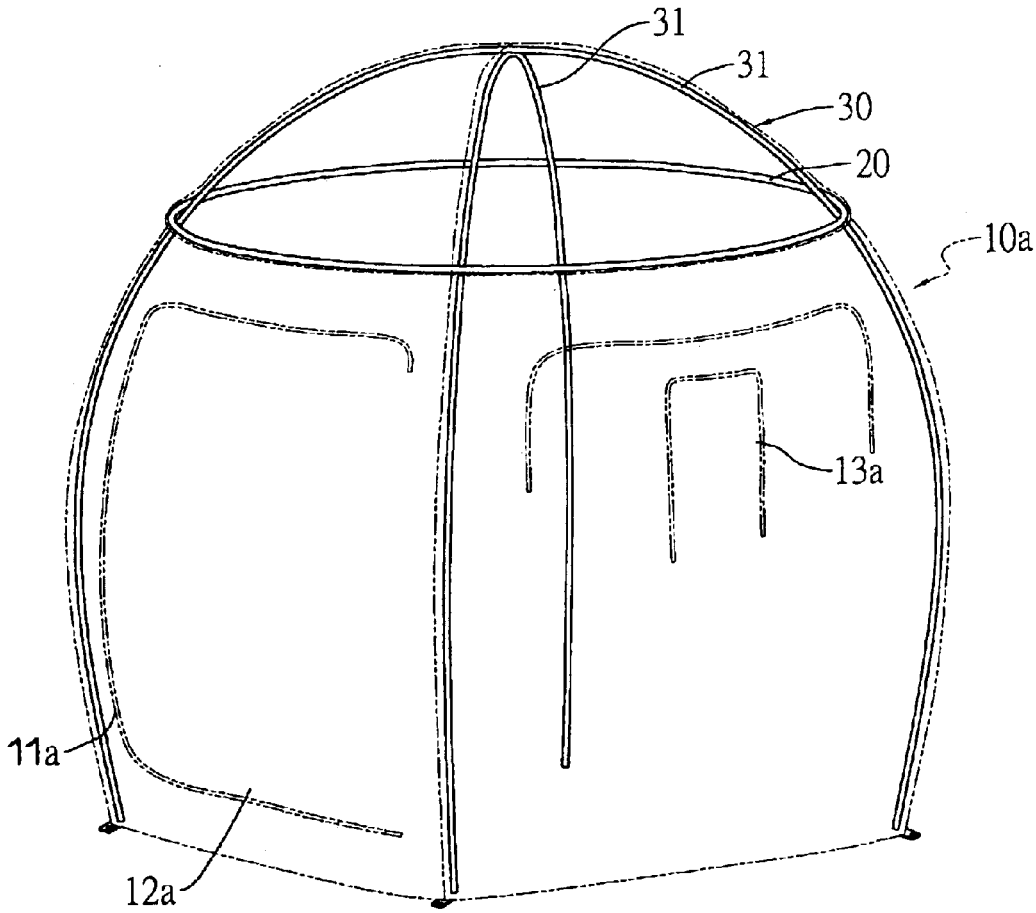
FIG. 1 is a perspective view of a closed tent in accordance with the invention, wherein a cloth is provided outside a framework of the tent.

Referring to FIG. 1, the closed tent has a cloth (10*a*) sheathed on a framework (30). The cloth (10*a*) has a door (11*a*) defined therethrough and closed by a zippered door cover (12*a*) jointed with the cloth (10*a*). A window (not numbered), preferably opposite to the door (11*a*), is defined through the cloth (10*a*) and closed by a zippered window cover (13*a*) jointed with the cloth (10*a*). The window can also be provided with a screen (not shown or numbered) inside the window piece (13*a*).

The framework (30) has at least two flexible strips (31) bent with an intersection at central points of the strips (31) as a top of the tent. A flexible ring (20) is formed outside the flexible strips (31) and adjacent to the top of the tent. The cloth (10*a*) can have tubular parts formed in an interior surface thereof for receiving the flexible strips (31) to spread the cloth (10*a*).

Figure 2:
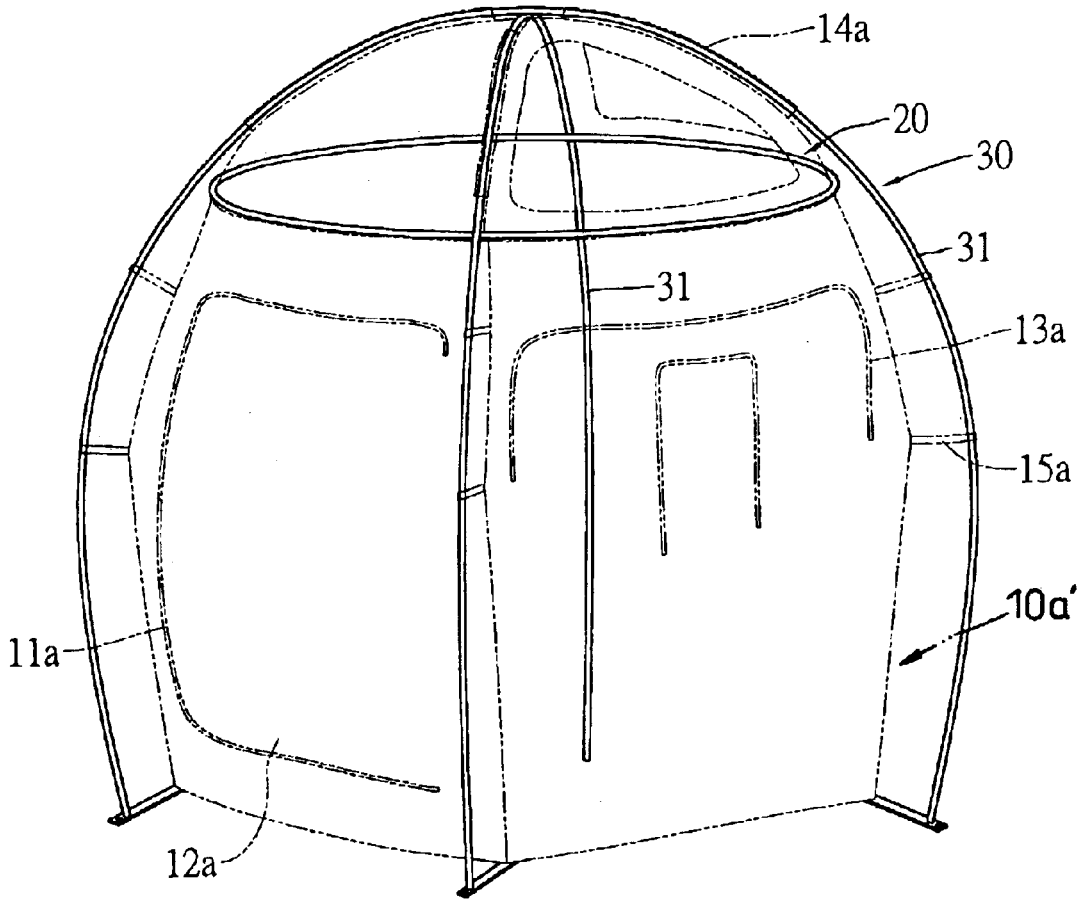
FIG. 2 is a perspective view of another closed tent in accordance with the invention, wherein the cloth is provided inside the framework of the tent.

Referring to FIG. 2, in another embodiment, the closed tent has a cloth (10*a*') fastened in the framework (30). The framework (30) has a structure the same as that in FIG. 1. The cloth (10*a*') also has the door (11*a*), the zippered door cover (12*a*), the window, and the zippered window cover (13*a*) the same as those in FIG. 1. The tubular parts (14*a*) are formed at an exterior surface of the cloth (10*a*), and the flexible strips (31) of the framework (30) are extended through the tubular parts (14*a*). Moreover, the cloth (10*a*) is provided with a plurality of loops (15*a*) to further fasten the flexible strips (31).

Referring to FIG. 3, in an embodiment of the open configuration, the tent has a cloth (10*b*) sheathed on the framework (30). The framework (30) has a structure the same as that in FIG. 1 or FIG. 2. The cloth (10*b*) has a dome (11*b*) provided outside a portion of the framework (30) above the flexible ring (20), and a plurality of side pieces (12*b*) provided outside the flexible strips (31) below the flexible ring (20). A plurality of openings (13*b*) is defined between the side pieces (12*b*). The bottom ends of the flexible strips (31) are secured on a bottom frame (14*b*).

Referring to FIG. 4, in a further embodiment, the opening tent has a plurality of nets (15*b*) respectively formed between the side pieces (12*b*) to close these openings (13*b*), wherein one of nets (15*b*) is provided with a zipper for entry and exit of the tent.

Thus, according to the present invention, the structures of the cloth and the framework are very simple, which is convenient to fold and unfold the tent. Moreover, the tent has a broad top space without a central pole, which is convenient to use in hunting or as a business site.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A tent comprising:

a framework having at least two flexible strips temporarily deformable into an arch and with an intersection at central points of the strips as a top of the tent, and a flexible ring provided outside the flexible strips and adjacent to the top of the tent; and a cloth spread on the framework, wherein the cloth has a dome provided outside a portion of the framework above the flexible ring, a plurality of side pieces provided outside the flexible strips below the flexible ring, and a plurality of openings defined between the side pieces.

2. The tent as claimed in claim 1, wherein the cloth has a door defined therethrough and closed by a zippered door cover jointed with the cloth.

3. The tent as claimed in claim 2, wherein the cloth has a window defined therethrough and closed by a zippered window cover jointed with the cloth.

4. The tent as claimed in claim 1, wherein bottom ends of the flexible strips are fastened on a bottom frame.

5. The tent as claimed in claim 1, wherein the cloth has a plurality of nets respectively formed between the side pieces to close these openings wherein one of nets is provided with a zipper.

6. The tent as claimed in claim 1, wherein the cloth is provided outside the framework.

7. The tent as claimed in claim 6, wherein the cloth has tubular parts formed at an interior surface thereof, and the flexible strips are received in the tubular parts to spread the cloth.

8. The tent as claimed in claim 1, wherein the cloth is provided inside the framework.

9. The tent as claimed in claim 8, wherein the cloth has tubular parts formed at an exterior surface thereof, and the flexible strips of the framework are extended through the tubular parts.

10. The tent as claimed in claim 9, wherein the cloth is provided with a plurality of loops to further fasten the flexible strips.

11. A tent comprising:

a framework having at least two flexible strips temporarily deformable into an arch and with an intersection at central points of the strips as a top of the tent, and a flexible ring provided outside the flexible strips and adjacent to the top of the tent; and a cloth spread on the framework, wherein the cloth is provided outside the framework and has tubular parts formed at an interior surface thereof, and the flexible strips are received in the tubular parts to spread the cloth.

12. A tent comprising:

a framework (30) having at least two flexible strips (31) temporarily deformable into an arch and with an intersection at central points of the strips (31) as a top of the tent, and a flexible ring (20) provided outside the flexible strips (31) and adjacent to the top of the tent; and a cloth spread on the framework, wherein the cloth is provided inside the framework.

13. The tent as claimed in claim 12, wherein the cloth has tubular parts formed at an exterior surface thereof, and the flexible strips of the framework are extended through the tubular parts.

14. The tent as claimed in claim 13, wherein the cloth is provided with a plurality of loops to further fasten the flexible strips.

* * * * *